US007396259B2

(12) United States Patent
Marshall

(10) Patent No.: US 7,396,259 B2
(45) Date of Patent: Jul. 8, 2008

(54) ELECTRICAL CONNECTOR HOUSING ALIGNMENT FEATURE

(75) Inventor: Robert E. Marshall, Elizabethtown, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/170,566

(22) Filed: Jun. 29, 2005

(65) Prior Publication Data

US 2007/0004287 A1 Jan. 4, 2007

(51) Int. Cl.
*H01R 13/64* (2006.01)

(52) U.S. Cl. ..... 439/680; 439/108; 439/157; 439/76.1

(58) Field of Classification Search ..... 439/680, 439/108, 608, 76.1, 157, 159
See application file for complete search history.

(56) References Cited

U.S. PATENT DOCUMENTS

| | | | | |
|---|---|---|---|---|
| 3,286,220 | A | 11/1966 | Marley et al. | 439/680 |
| 3,538,486 | A | 11/1970 | Shlesinger, Jr. | 439/268 |
| 3,669,054 | A | 6/1972 | Desso et al. | 113/119 |
| 3,748,633 | A | 7/1973 | Lundergan | 339/217 S |
| 4,076,362 | A | 2/1978 | Ichimura | 339/75 |
| 4,159,861 | A | 7/1979 | Anhalt | 339/75 |
| 4,260,212 | A | 4/1981 | Ritchie et al. | 339/97 R |
| 4,288,139 | A | 9/1981 | Cobaugh et al. | 339/74 R |
| 4,383,724 | A | 5/1983 | Verhoeven | 439/510 |
| 4,402,563 | A | 9/1983 | Sinclair | 339/75 |
| 4,560,222 | A | 12/1985 | Dambach | 339/75 |
| 4,717,360 | A | 1/1988 | Czaja | 439/710 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |
| 4,907,990 | A | 3/1990 | Bertho et al. | 439/851 |
| 4,973,271 | A | 11/1990 | Ishizuka et al. | 439/839 |
| 5,077,893 | A | 1/1992 | Mosquera et al. | 29/882 |
| 5,174,770 | A | 12/1992 | Sasaki et al. | 439/108 |
| 5,238,414 | A | 8/1993 | Yaegashi et al. | 439/108 |
| 5,254,012 | A | 10/1993 | Wang | 439/263 |
| 5,274,918 | A | 1/1994 | Reed | 29/882 |
| 5,302,135 | A | 4/1994 | Lee | 439/263 |
| 5,431,578 | A | 7/1995 | Wayne | 439/259 |
| 5,475,922 | A | 12/1995 | Tamura et al. | 29/881 |
| 5,558,542 | A | 9/1996 | O'Sullivan et al. | 439/682 |
| 5,590,463 | A | 1/1997 | Feldman et al. | 29/844 |
| 5,609,502 | A | 3/1997 | Thumma | 439/747 |
| 5,672,064 | A | 9/1997 | Provencher et al. | 439/79 |
| 5,730,609 | A | 3/1998 | Harwath | 439/108 |

(Continued)

FOREIGN PATENT DOCUMENTS

| | | | |
|---|---|---|---|
| EP | 0 273 683 | A2 | 7/1988 |

(Continued)

*Primary Examiner*—Truc T Nguyen
(74) *Attorney, Agent, or Firm*—Woodcock Washburn LLP

(57) ABSTRACT

An electrical connector receptacle housing is provided that includes protrusions in the housing's contact assembly receiving area. The location of each protrusion corresponds to a location of a well formed in a contact assembly between dual beams of ground contacts. When the contact block is received in the housing, each protrusion is received in a corresponding well. The protrusions may be sized to provide a snug fit as the contact block is received in the receptacle housing. The protrusions thus help minimize the movement of the contact block.

28 Claims, 14 Drawing Sheets

U.S. PATENT DOCUMENTS 5,733,148 A * 3/1998 Kaplan et al. ..... 439/680
5,741,144 A 4/1998 Elco et al. ..... 439/101
5,741,161 A 4/1998 Cahaly et al. ..... 439/709
5,795,191 A 8/1998 Preputnick et al. ..... 439/608
5,816,829 A * 10/1998 Chiang ..... 439/76.1
5,817,973 A 10/1998 Elco et al. ..... 174/32
5,860,816 A 1/1999 Provencher et al. ..... 439/79
5,908,333 A 6/1999 PErino et al. ..... 439/631
5,961,355 A 10/1999 Morlion et al. ..... 439/686
5,971,817 A 10/1999 Longueville ..... 439/857
5,980,321 A 11/1999 Cohen et al. ..... 439/608
5,993,259 A 11/1999 Stokoe et al. ..... 439/608
6,050,862 A 4/2000 Ishii ..... 439/843
6,068,520 A 5/2000 Winings et al. ..... 439/676
6,123,554 A 9/2000 Ortega et al. ..... 439/79
6,125,535 A 10/2000 Chiou et al. ..... 29/883
6,139,336 A 10/2000 Olson ..... 439/83
6,146,157 A 11/2000 Lenoir et al. ..... 439/101
6,146,202 A * 11/2000 Ramey et al. ..... 439/608
6,146,203 A 11/2000 Elco et al. ..... 439/609
6,190,213 B1 2/2001 Reichart et al. ..... 439/736
6,212,755 B1 4/2001 Shimada et al. ..... 29/527.1
6,219,913 B1 4/2001 Uchiyama ..... 29/883
6,220,896 B1 4/2001 Bertoncici et al. ..... 439/608
6,267,604 B1 7/2001 Mickievicz et al. ..... 439/79
6,269,539 B1 8/2001 Takahashi et al. ..... 29/883
6,293,827 B1 9/2001 Stokoe et al. ..... 439/608
6,319,075 B1 11/2001 Clark et al. ..... 439/825
6,328,602 B1 12/2001 Yamasaki et al. ..... 439/608
6,347,952 B1 2/2002 Hasegawa et al. ..... 439/608
6,350,134 B1 2/2002 Fogg et al. ..... 439/79
6,363,607 B1 4/2002 Chen et al. ..... 29/883
6,371,773 B1 4/2002 Crofoot et al. ..... 439/79
6,379,188 B1 4/2002 Cohen et al. ..... 439/608
6,409,543 B1 6/2002 Astbury, Jr. et al. ..... 439/608
6,431,914 B1 8/2002 Billman ..... 439/608
6,435,914 B1 8/2002 Billman ..... 439/608
6,461,202 B2 10/2002 Kline ..... 439/701
6,471,548 B2 10/2002 Bertoncini et al. ..... 439/608
6,506,081 B2 1/2003 Blanchfield et al. ..... 439/682
6,537,111 B2 3/2003 Brammer et al. ..... 439/857
6,551,144 B2 * 4/2003 Wellmann et al. ..... 439/689
6,554,647 B1 4/2003 Cohen et al. ..... 439/607
6,572,410 B1 6/2003 Volstorf et al. ..... 439/608
6,652,318 B1 11/2003 Winings et al. ..... 439/608
6,692,272 B2 2/2004 Lemke et al. ..... 439/108
6,709,298 B2 * 3/2004 Bradley ..... 439/701
6,743,057 B2 6/2004 Davis et al. ..... 439/701
6,899,566 B2 * 5/2005 Kline et al. ..... 439/608
2003/0143894 A1 7/2003 Kline et al. ..... 439/608

FOREIGN PATENT DOCUMENTS

JP 06-236788 8/1994
JP 07-114958 5/1995
JP 2000-003743 1/2000
JP 2000-003744 1/2000
JP 2000-003745 1/2000
JP 2000-003746 1/2000
WO WO 01/29931 A1 4/2001
WO WO 01/39332 A1 5/2001

* cited by examiner

ELECTRICAL CONNECTOR HOUSING ALIGNMENT FEATURE

CROSS REFERENCE TO RELATED APPLICATIONS

The present invention relates to U.S. patent application having Ser. No. 10/232,883 filed Aug. 30, 2002, entitled "Electrical Connector Having A Cored Contact Assembly" which is assigned to the assignee of the present application and hereby incorporated herein by reference in its entirety.

FIELD OF THE INVENTION

The invention relates to electrical connectors and specifically to improved alignment features in electrical connector housings.

BACKGROUND OF THE INVENTION

An electrical connector may electrically connect to another electrical connector or to a device such as, for example, a motherboard or a daughter card. Additionally, a receptacle connector, for example, connected to a motherboard also may be electrically connected to a plug connector that is connected to a daughter card, resulting in an electrical connection between the motherboard and daughter card. A receptacle connector may include one or more receptacle contact assemblies received in a receptacle housing.

FIG. 1 is a perspective view of a receptacle connector 1100, and FIG. 2 is a perspective view of a receptacle housing 1112 of the receptacle connector 1100. The receptacle connector 1100 may include a receptacle contact assembly 1160 received in the receptacle housing 1112. Male latch portions 1162A, 1162B on the receptacle contact assembly 1160 may be received in respective female latch portions 1114A, 1114B of the receptacle housing 1112. A bottom side 1161 of the contact block 1168 may abut flat surfaces 1115 of a contact assembly receiving area 1113 of the receptacle housing 1112. The respective placement of the latch portions 1162A, 1162B, 1114A, 1114B may provide for the proper positioning of the receptacle contact assembly 1160 in the receptacle housing 1112.

A problem, however, may occur if, for example, a load is applied on the electrical connector in a direction indicated by the arrow L shown in FIG. 1A. Such a load may be applied when, for example, a plug connector (not shown) is mated to the receptacle connector 1100. The force applied during mating may cause the assembled male and female latch portions 1162A, 1162B, 1114A, 1114B to deflect, and receptacle contacts 1175 to interfere with inside surfaces of the receptacle housing 1112. There is a need, therefore, to prevent deflection of the assembled male and female latch portions when such a load is placed on the connector system.

SUMMARY OF THE INVENTION

The invention may include providing protrusions formed as part of or attached to a receptacle housing in the housing's contact assembly receiving area. The location of each protrusion may correspond to a location of a well in a contact assembly. Each well may be located between dual beams of ground contact terminals and may be disposed to receive ground contacts of a plug connector. Thus when the contact assembly is received in the receptacle housing, each protrusion is received in a corresponding well. The protrusions may be sized to provide a snug fit to help minimize the movement of the contact assembly.

Additionally, the protrusions may be located to perform a polarizing function, preventing the contact assembly from being received in the receptacle connector housing in an incorrect orientation. Such polarization may help reduce the risk that a plug connector ground contact will be inserted into a location of the contact assembly that does not include a well, thus helping to ensure that plug connector ground contacts will not be damaged by being inserted in an incorrect location. Press-fitting the receptacle housing protrusions into the receptacle contact assembly wells may also help minimize shear stress placed on a connector system when used, for example, to mate a vertical motherboard with a horizontal daughter card.

DETAILED DESCRIPTION OF ILLUSTRATIVE EMBODIMENTS

Figure 1:
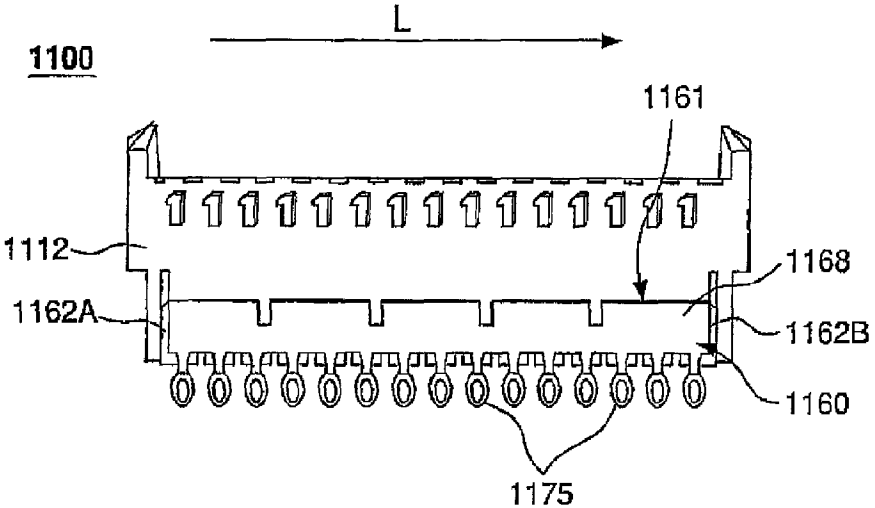
FIG. 1 is a perspective view of an example prior art receptacle connector.
Figure 2:
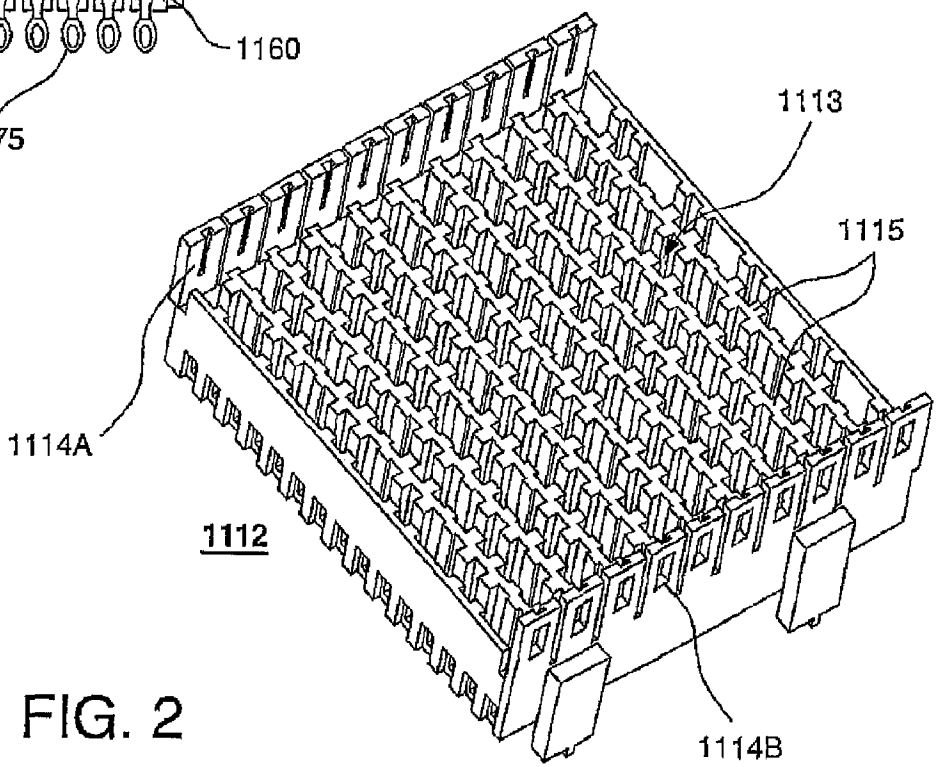
FIG. 2 is a perspective view of an example prior art receptacle housing.
Figure 3A:
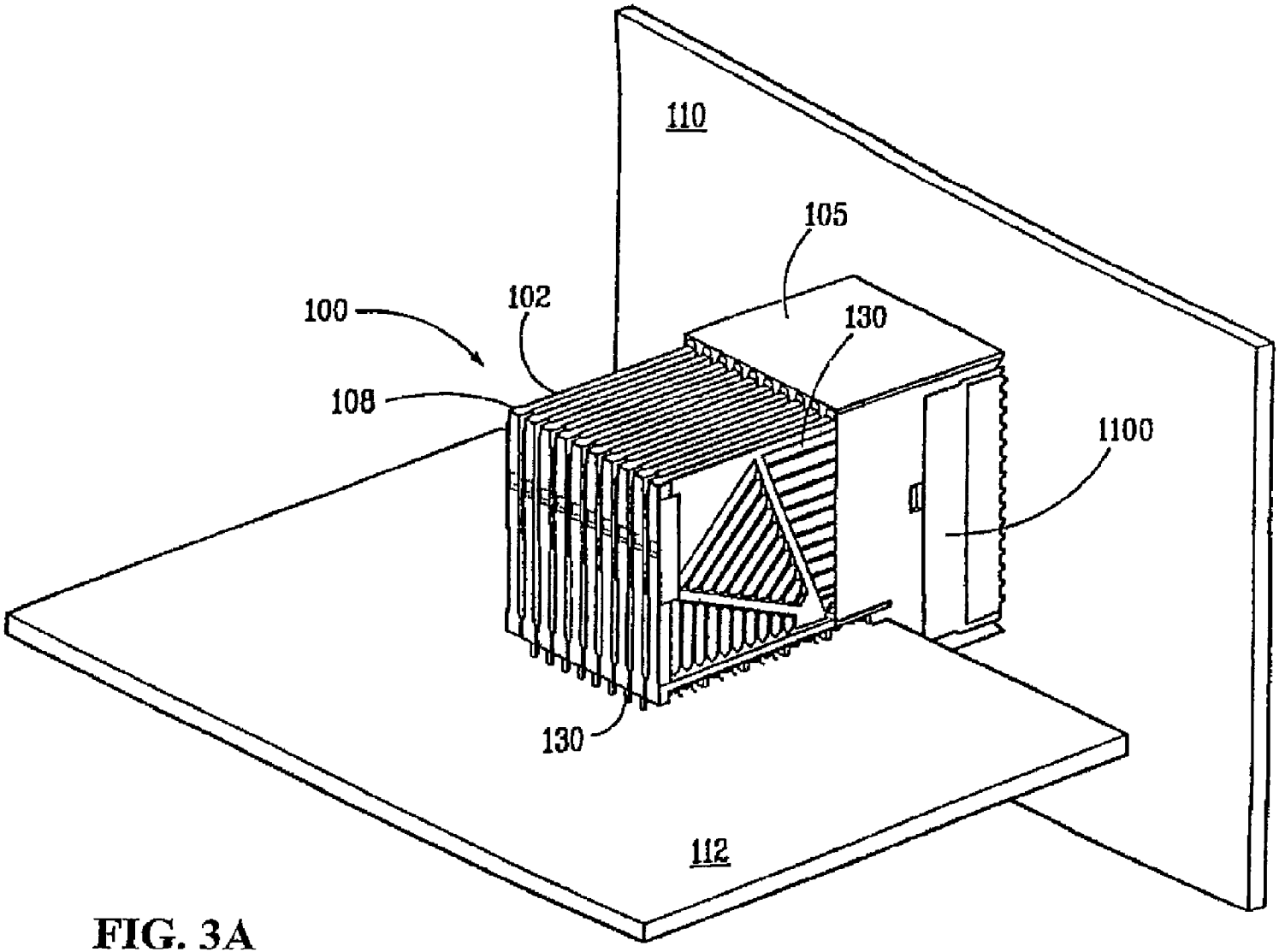
FIG. 3A is a perspective view of a backplane system having an exemplary right angle electrical connector in accordance with the invention.

FIG. 3A is a perspective view of a backplane system 110 having an exemplary right angle electrical connector 100 in accordance with an embodiment of the invention. However, the invention may take other forms such as a vertical or horizontal electrical connector. As shown in FIG. 3A, connector 100 comprises a plug connector 102 and receptacle connector 1100.

Plug connector 102 comprises housing 105 and a plurality of lead assemblies 108. The housing 105 is configured to contain and align the plurality of lead assemblies 108 such that an electrical connection suitable for signal communication is made between a first electrical device 112 and a second electrical device 110 via receptacle connector 1100. In one embodiment of the invention, electrical device 110 is a backplane and electrical device 112 is a daughter card. Electrical devices 110 and 112 may, however, be any electrical device without departing from the scope of the invention.

As shown, the connector 102 comprises a plurality of lead assemblies 108. Each lead assembly 108 comprises a column of contacts 130 therein as will be described below. Each lead assembly 108 comprises any number of contacts 130.

Figure 3B:
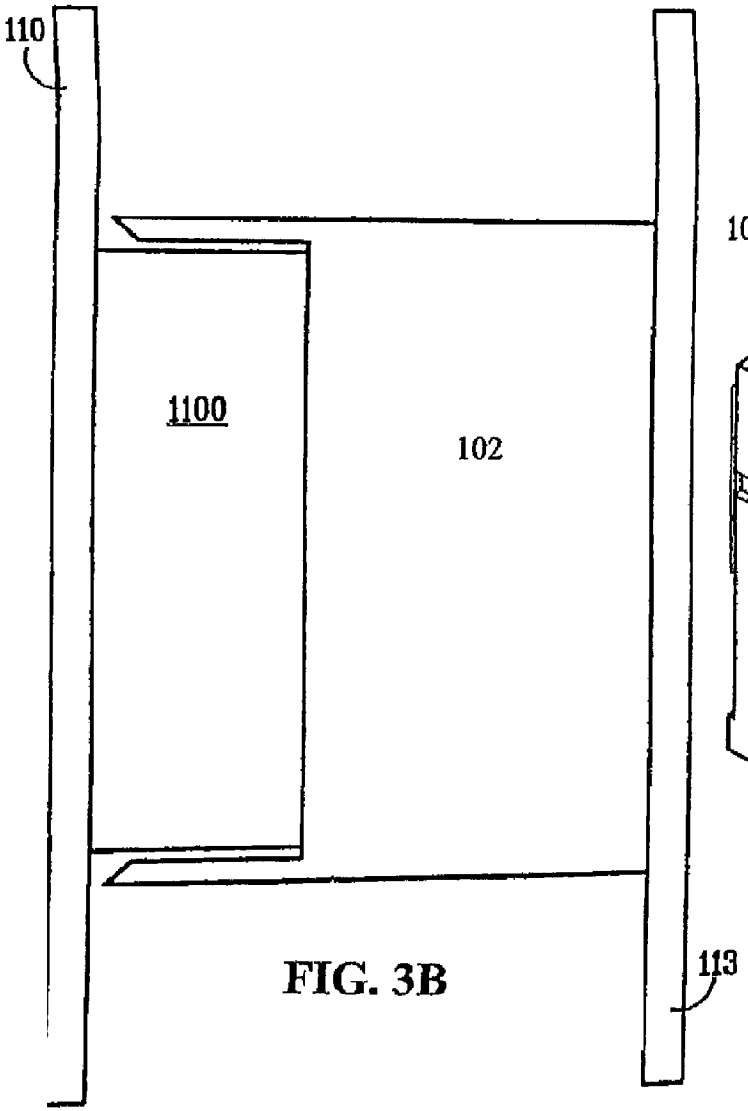
FIG. 3B is a simplified view of a board-to-board system having a vertical connector in accordance with the invention.

FIG. 3B is a board-to-board system similar to FIG. 3A except plug connector 102 is a vertical plug connector rather than a right angle plug connector. This embodiment makes electrical connection between two parallel electrical devices 110 and 113.

Figure 4:
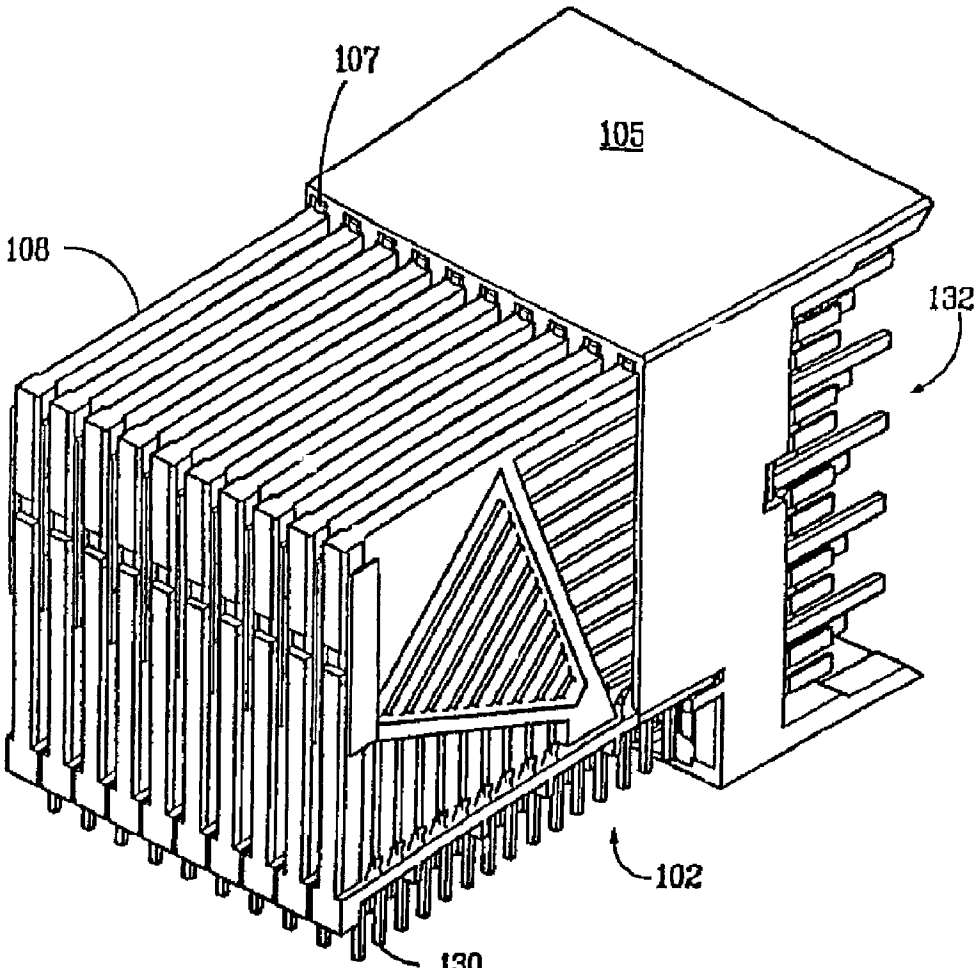
FIG. 4 is a perspective view of the plug connector of the backplane system shown in FIG. 3A.

FIG. 4 is a perspective view of the plug connector 102 of FIG. 3A shown without electrical devices 110 and 112 and receptacle connector 1100. As shown, slots 107 are formed in the housing 105 that contain and align the lead assemblies 108 therein. In one embodiment, the housing 105 is made of plastic, however, any suitable material may be used without departing from the scope of the invention. FIG. 4 also shows connection pins 130, 132. Connection pins 130 connect connector 102 to electrical device 112. Connection pins 132 electrically connect connector 102 to electrical device 110 via receptacle connector 1100. Connection pins 142 may be adapted to provide through-mount or surface-mount connections to an electrical device (not shown).

Figure 5:
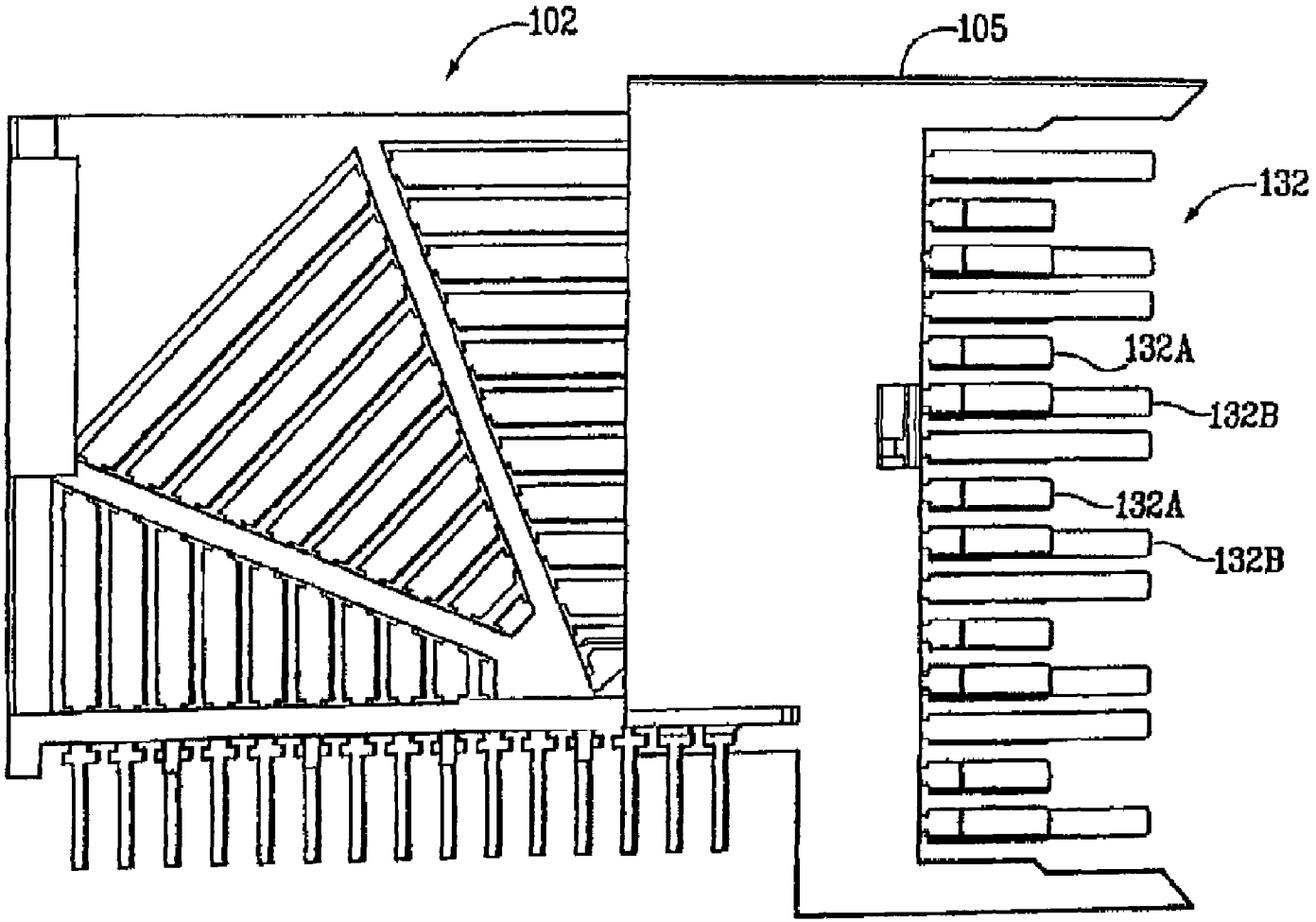
FIG. 5 is a side view of the plug connector of the backplane system shown in FIG. 3A.

FIG. 5 is a side view of plug connector 102 as shown in FIG. 4. As shown, in this configuration, the terminals (i.e., that portion of the contact that is mated with another connector or device) of the contacts 132 used to connect to receptacle connector 1100 vary in length, i.e. the terminals extend in varied lengths from the end of the housing 105. For example, as shown, ground terminals 132B extend a greater distance from housing 105 than signal terminals 132A. During the mating of the plug connector 102 to receptacle connector 1100, such configuration provides that the longer ground terminals 132B on plug 102 will mate with the corresponding ground terminals 1175B on the receptacle connector 1100 before the shorter signal terminals 132A mate with the corresponding signal terminals 1175A on the receptacle connector 1100. Such a configuration can be used to ensure that signal integrity is maintained when the plug 102 is mated with the receptacle connector 1100.

Figure 6:
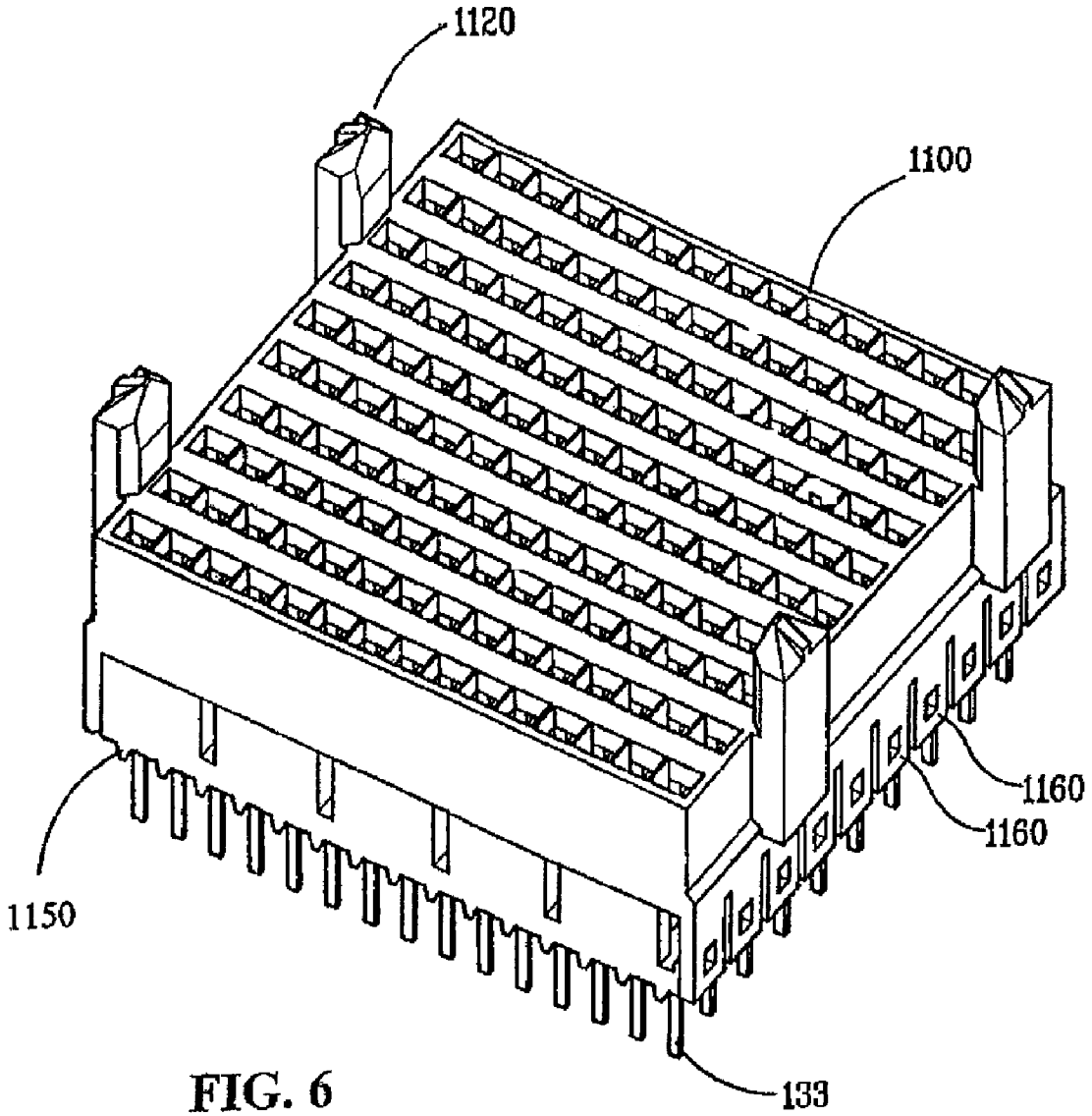
FIG. 6 is a perspective view of the receptacle connector of the backplane system shown in FIG. 3A.
Figure 7:
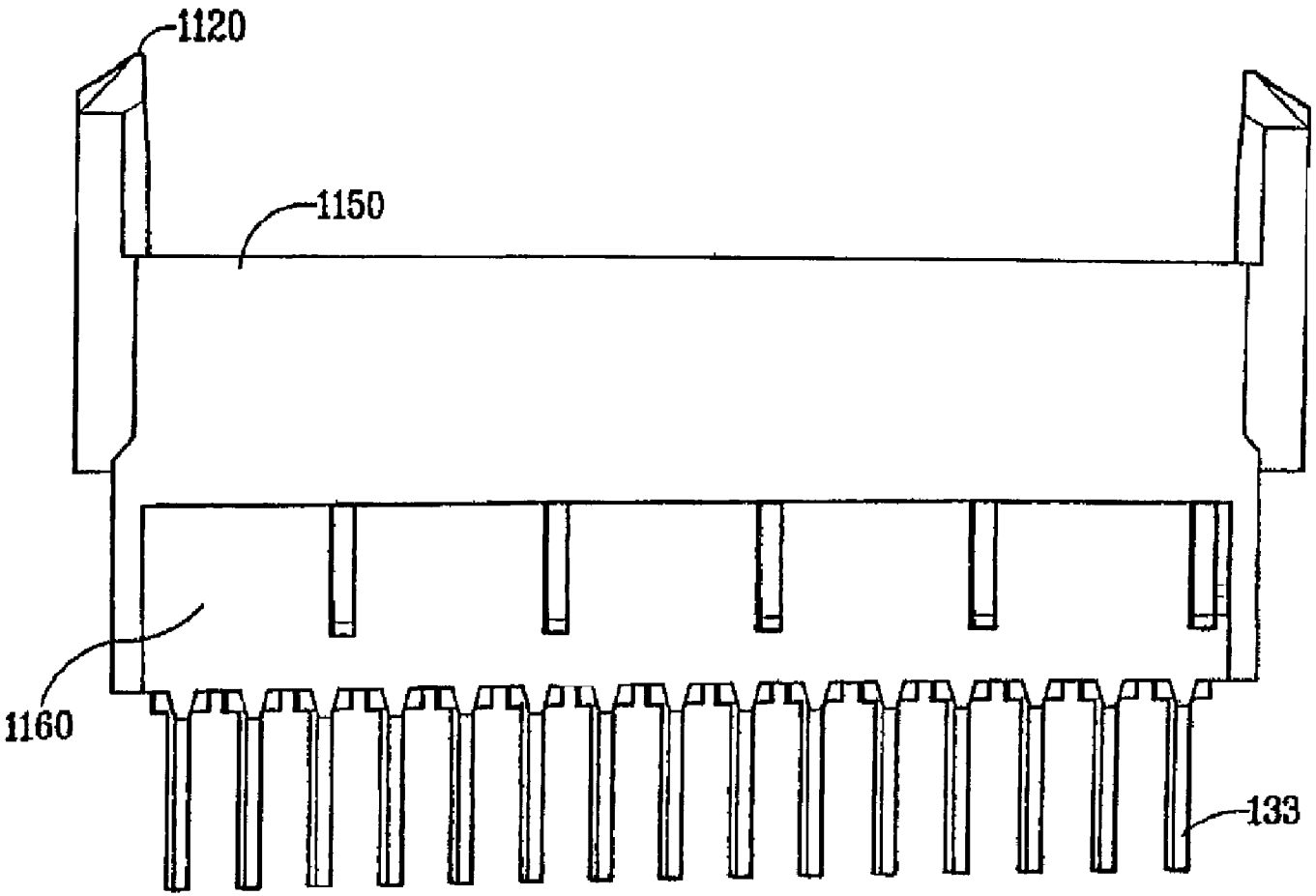
FIG. 7 is a side view of the receptacle connector shown in FIG. 6.

FIGS. 6 and 7 are a perspective view and side view, respectively, of the receptacle connector 1100 of the backplane system shown in FIG. 3A. In this manner, the receptacle connector 1100 may be mated with the plug connector 102 (as shown in FIG. 3A) and used to connect two electrical devices. Specifically, connection pins or contact terminals 133 (as shown in FIG. 3) may be inserted into, for example, vias (not shown) on device 110 to electrically connect the plug connector 102 to device 110. In another embodiment of the invention, the connection pins 133 may be eye-of-the-needle pins for use in press-fit applications or a surface mount configuration.

Receptacle connector 1100 also includes alignment structures 1120 to aid in the alignment and insertion of the plug connector 102 into the receptacle connector 1100. Once inserted, structures 1120 also serve to secure the plug connector in the receptacle connector 1100. Such structures 1120 thereby resist any movement that may occur between the plug connector 102 and the receptacle connector 1100 that could result in mechanical breakage therebetween.

The receptacle connector 1100 includes a plurality of receptacle contact assemblies 1160 each containing a plurality of terminals 133 (only the tails of which are shown in FIG. 6) configured in rows. The terminals 133 provide the electrical pathway between the connector 100 and any mated electrical device (not shown).

Figure 8:
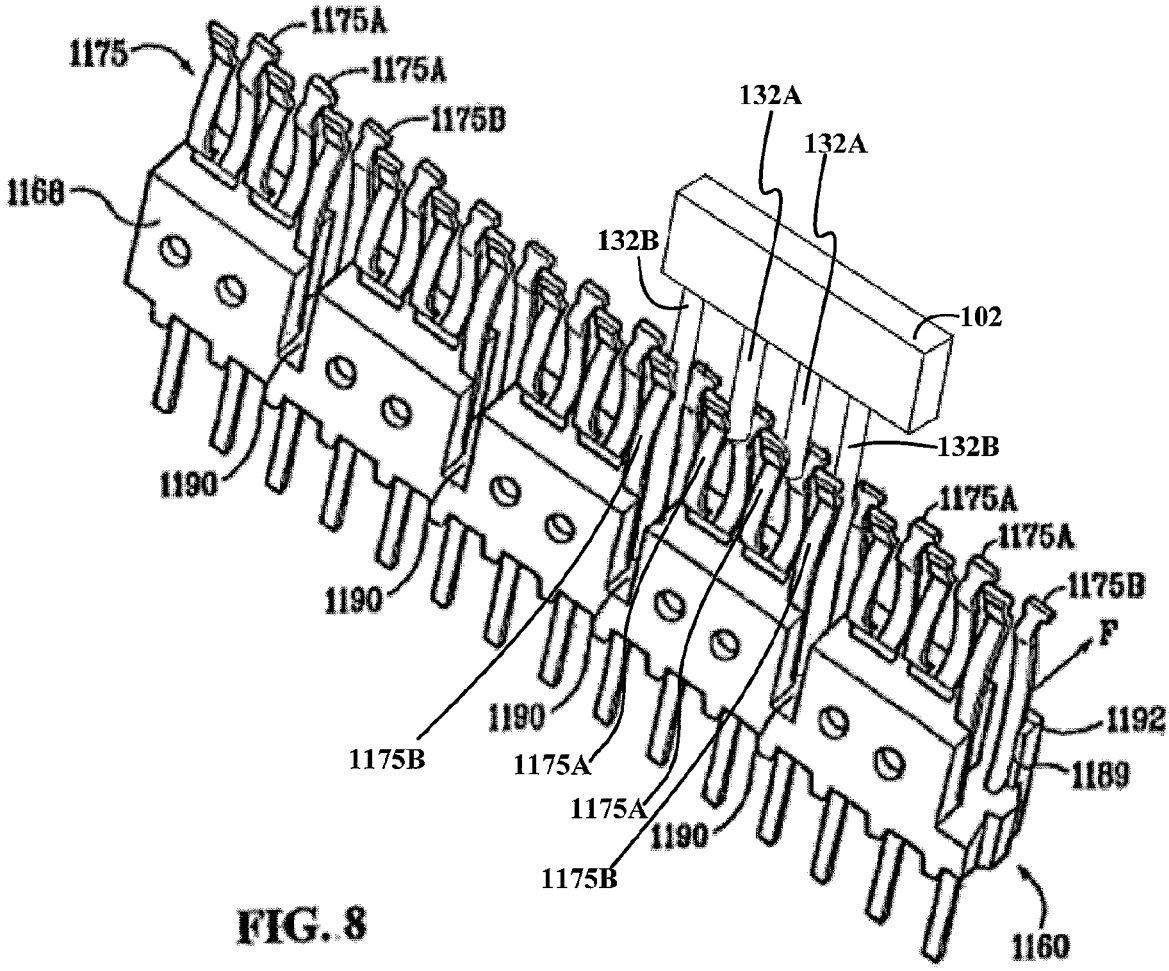
FIG. 8 provides a perspective view of an example contact assembly.

FIG. 8 provides a perspective view of a single receptacle contact assembly 1160 not contained in a receptacle housing 1150. As shown, the assembly 1160 includes a plurality of dual beam conductive contacts 1175 extending through a contact block 1168. The contact block is typically made from an insulating material. As shown in FIG. 8, and in one embodiment of the invention, contacts comprise ground contacts 1175B and signal contacts 1175A and are configured within the contact block 1168 in a signal-signal-ground configuration. To illustrate, starting from the left hand portion of the assembly 1160, the first and second contacts are signal contacts 1175A and the third contact is a ground terminal 1175B, such contact pattern continues along the length of the assembly 1160. Also as shown in FIG. 8, the assembly contains five sets of contacts, each set in a signal-signal-ground configuration.

As shown, the signal contacts 1175A have a dual beam configuration on one side of the contact block 1168 and a straight pin configuration on the other side of the contact block 1168. In another embodiment of the invention, the straight pin configuration of the signal contacts 1175A could be replaced with an eye-of-the-needle configuration for press fit applications or a surface mount configuration.

Also, as shown, the ground contacts 1175B have a dual beam configuration on one side of the contact block 1168 and a straight pin configuration on the other side of the contact block 1168. In another embodiment of the invention, the straight pin configuration of the ground contacts 1175B could be replaced with an eye-of-the-needle configuration for press fit applications or a surface mount configuration.

In accordance with one aspect of the invention, the contact block 1168 includes wells 1190. The wells 1190 may be wells or portions of the contact block 1168 that are cut out to allow the shorter signal contacts 132A of the plug connector 102 to mate with the signal contacts 1175A of the receptacle connector 1100 in such a way that the ground contacts 132B do not interfere with or prematurely bottom out on the contact block 1168. In one embodiment of the invention and as shown in FIG. 8, the wells 1190 are located between the dual beams of ground contacts 1175B.

In this manner, when the plug connector 102 is inserted the into receptacle connector 1100, the ground contacts 132B of the plug connector 102 are first to contact the dual beams of the ground contacts 1175B of the receptacle connector 1100. This occurs because the ground contacts 132B extend farther from the plug housing 105 than the signal contacts 132A, as described above. Thereafter, the ground contacts 132B extend between the dual beams of ground contacts 1175B and are inserted into wells 1190. The shorter signal contacts 132A then contact the signal contacts 1175A in the receptacle connector 1100. By providing wells 1190 between the dual beams of ground contacts 1175B, the shorter signal contacts 132A of the plug 102 can mate with the signal contacts 1175A of the receptacle connector 1100 in such a way that ground contacts 132B do not interfere with or prematurely bottom out on contact block 1168.

Further, by providing wells 1190 between the dual beams of the ground contact 1175B, the spring rate of the ground contact 1175B can be controlled to provide a desired spring rate. As addressed above, the spring rate of the ground contact 1175B is defined as the distance the contact moves (deflection) when force is applied thereto.

To illustrate, when a ground contact 132B is inserted into ground contact 1175B, the force of the insertion deflects ground contact 1175B in a direction indicated by arrow F as shown in FIG. 8. Typically, such direction is normal to the length of the ground terminal 1175B. The spring rate of ground contact 1175B is controlled by the fulcrum point 1192. In the embodiments shown in FIGS. 8 and 9, the fulcrum point 1192 is the uppermost point of well sidewall 1189 where the ground contact 1175B abuts the contact block 1168 and serves as the fulcrum when a contact such as the ground contact 132B is inserted into the dual beam ground contact 1175B. For example, in one embodiment, the tooling used to form the well can be adjusted independently of tooling used to form the fulcrum point on the sidewall. For example, each of these specifications can correspond to a customer specification.

Figure 9:
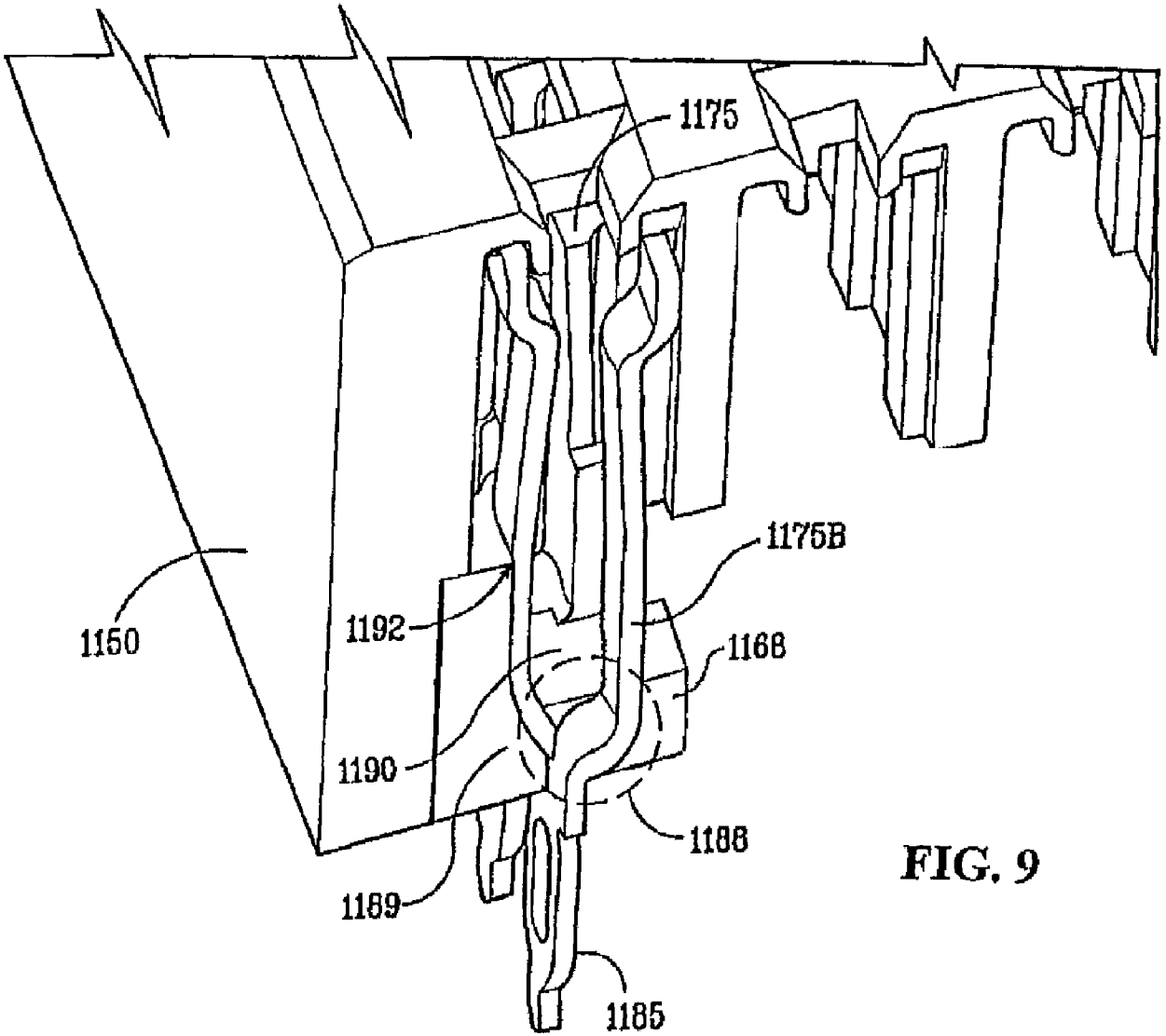
FIG. 9 provides a detailed view of a portion of an example receptacle.

FIG. 9 shows a detailed view of a portion of a receptacle contact assembly in accordance with the invention and contained in receptacle housing 1150. As shown, ground contacts 1175B are dual beam contacts for accepting a corresponding ground contact 132B from the plug connector 102. Ground contacts 1175B also have an eye-of-the-needle configuration for insertion into an electrical device (not shown) such as device 110 shown in FIG. 3A. The eye-of-the-needle configuration provides an oversized fit in a press-fit mounting application. However, as mentioned above, a surface mount configuration is possible.

Also shown in FIG. 9 is an encapsulated portion 1188 of ground contact 1175B. In this manner, the encapsulated portion 1188 is contained within contact block 1168. The encapsulated formed area may be a deformation in the contact terminal, such as an integral bend or kink in the terminal. The deformation may also be a separate barb attached to the terminal and contained in the contact block.

In one embodiment, the encapsulated portion is formed by using insert molding. In this manner, the contact terminals are stamp formed with a deformation portion positioned in a manner such that when the contact block 1168 is formed, the deformation area 1188 is encapsulated in the contact block 1168. Such a portion increase the mechanical integrity of the ground contact and reduces mechanical breakage when the receptacle is mated with either device such as the device 110 or the plug connector 102. The encapsulated formed area may vary without departing from the scope of the present invention.

Figure 10:
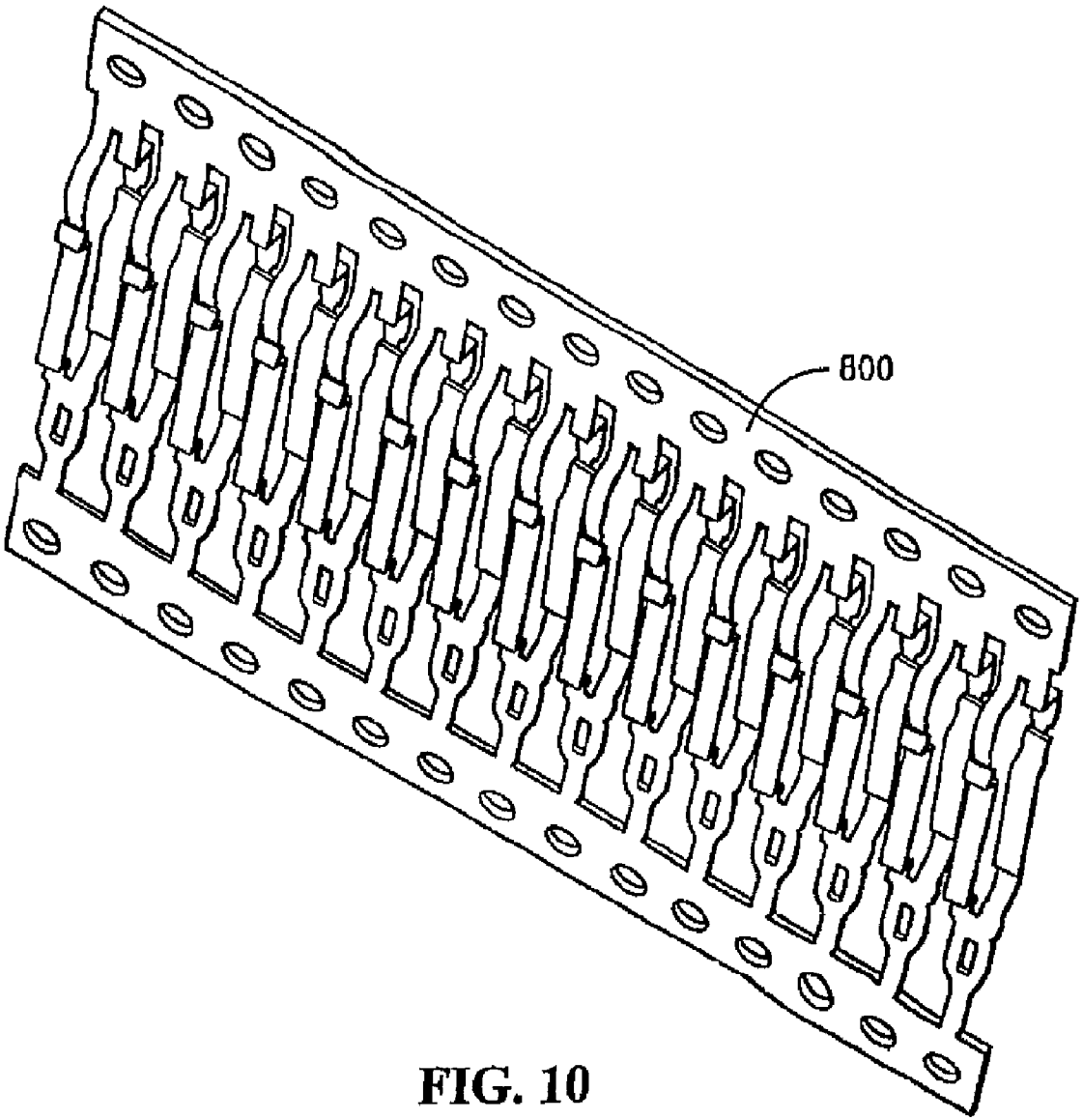
FIG. 10 is a perspective view of a row of stamped contact terminals that may be used to form a contact assembly in accordance with the invention.

In one embodiment of the invention, the contact block 1168 and wells 1190 are formed using insert molding. In this manner, a row of stamped contact terminals 800, as shown in FIG. 10, are inserted into a mold cavity and well pins (not shown) are used to contain and position the row of terminals in a precise location. The well pins are also used to form wells 1190, which will be described in more detail below.

Thereafter, once the contacts and well pins are positioned, molten plastic is injected into the mold cavity and allowed to form around the contacts and well pins. The molten plastic is then cooled and the well pins and the mold are removed. The result is a plastic contact block having wells 1190 with a desired position and depth and encapsulating the row of contacts.

It is also contemplated that varying the depth of wells 1190 in contact block 1168 provides for a desired contact wipe. Contact wipe is a deviation parameter used to allow for curvatures that may exist in an electrical device that results in non-simultaneous contact mating when connectors are mated. In this manner, increasing the depth of the well allows for greater contact wipe.

In one embodiment, a discrete set of wells are formed in the contact block using well pins. In this manner, the well pins are positioned in discrete positions in the center of the contact row and at a determined depth and position that will result in discrete wells within the contact block having a desired depth and position. Again, in one embodiment, the wells are positioned between the dual beams of ground contacts 1175B as shown in FIG. 8 and are adapted to receive ground contacts 132B of the plug connector 102.

Figure 11:
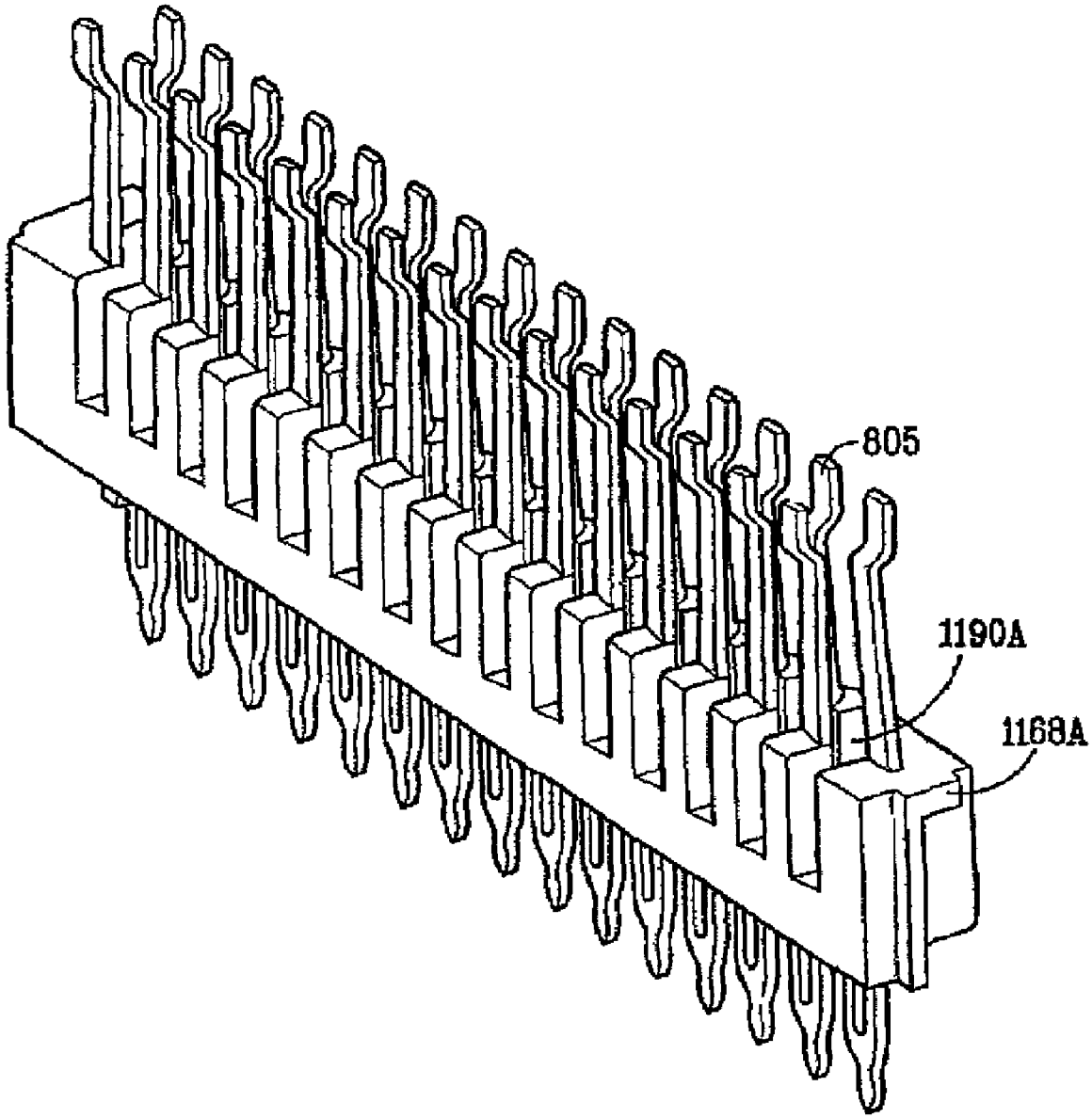
FIG. 11 is a perspective view of an alternative contact assembly.
Figure 12:
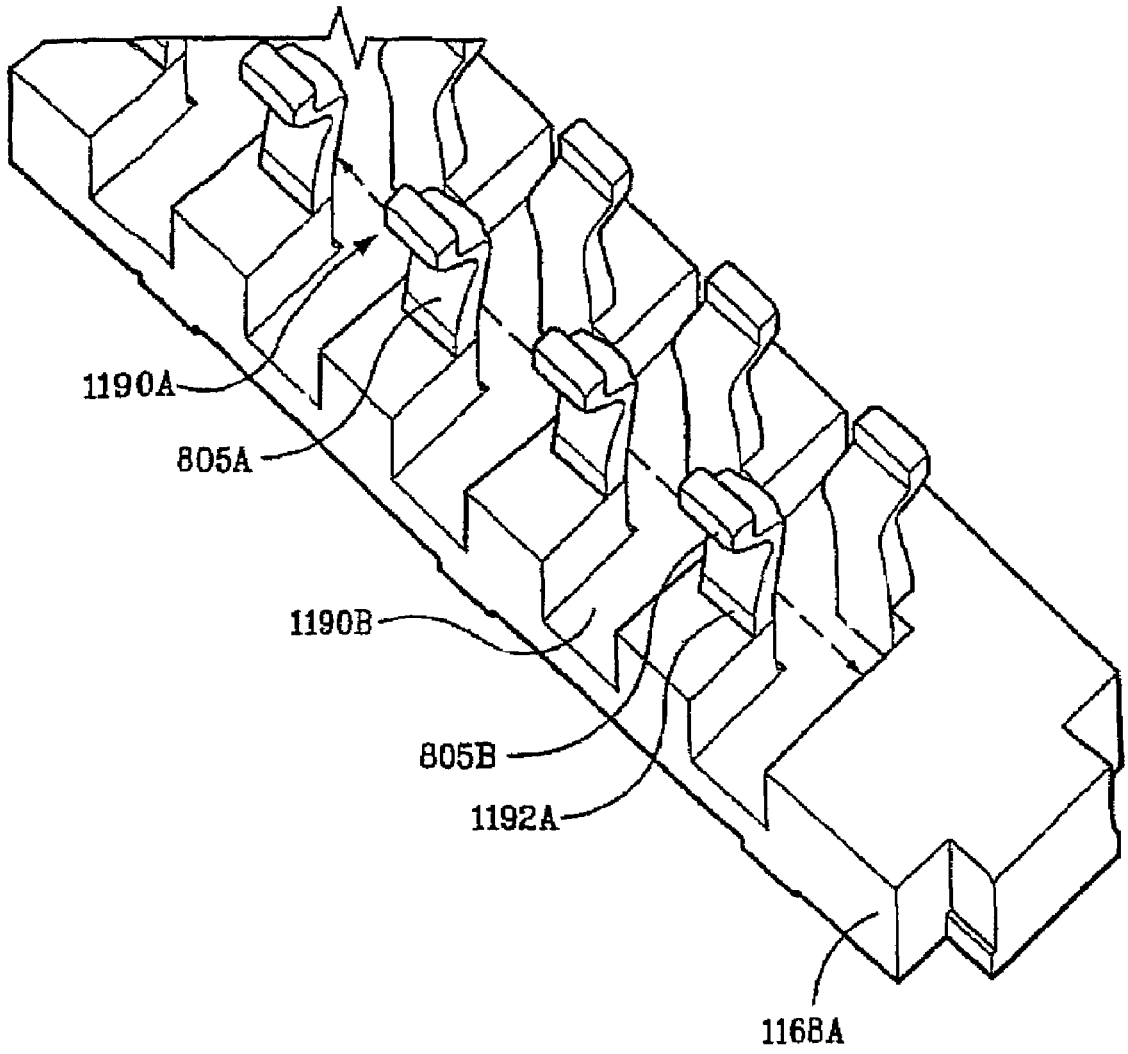
FIG. 12 is a top perspective view of the contact assembly of FIG. 11.

In another embodiment of the invention, the well pins are used to create a continuous open section through the center of the contact row of a determined depth and position that will result in one continuous well having a desired depth and position. Such an embodiment is shown in FIGS. 11 and 12. As shown in FIGS. 11 and 12, a single well 1190A extends along the center of contact block 1168A. Additionally, wells 1190B are formed between adjacent terminals 805A and 805B (FIG. 12).

Figure 13:
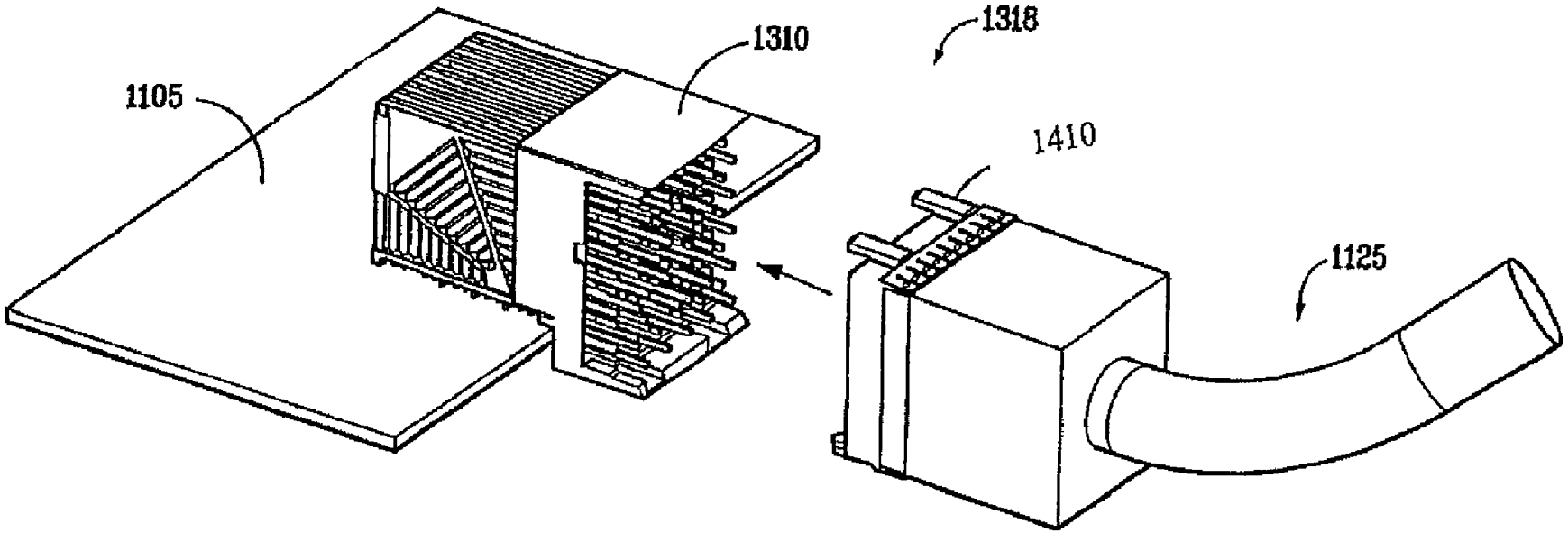
FIG. 13 is a perspective view of an alternative example connector.

FIG. 13 is a perspective view of a connector system 1318 in accordance with another embodiment of the invention. As shown, a plug connector 1310 and receptacle connector 1410 are used in combination to connect an electrical device, such as circuit board 1105 to a cable 1125. Specifically, when the plug connector 1310 is mated with the receptacle connector 1410, an electrical connection is established between the board 1305 and the cable 1125. The cable 1125 can then transmit signals to any electrical device (not shown) suitable for receiving such signals.

Figures 14, 15:
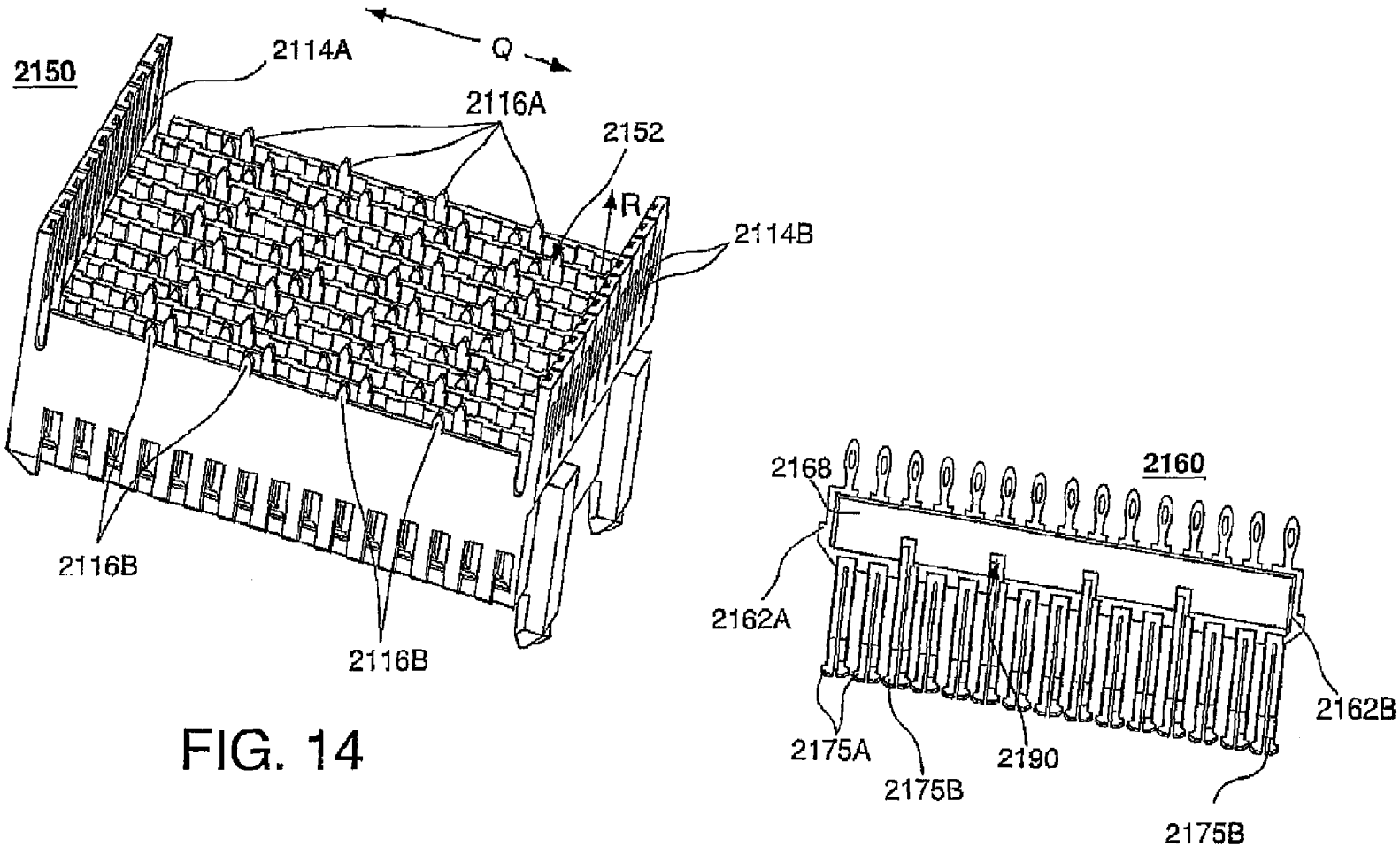
FIG. 14 is a perspective view of an example embodiment of a receptacle housing according to the invention.
FIG. 15 is a perspective view of an alternative contact assembly
Figure 18:
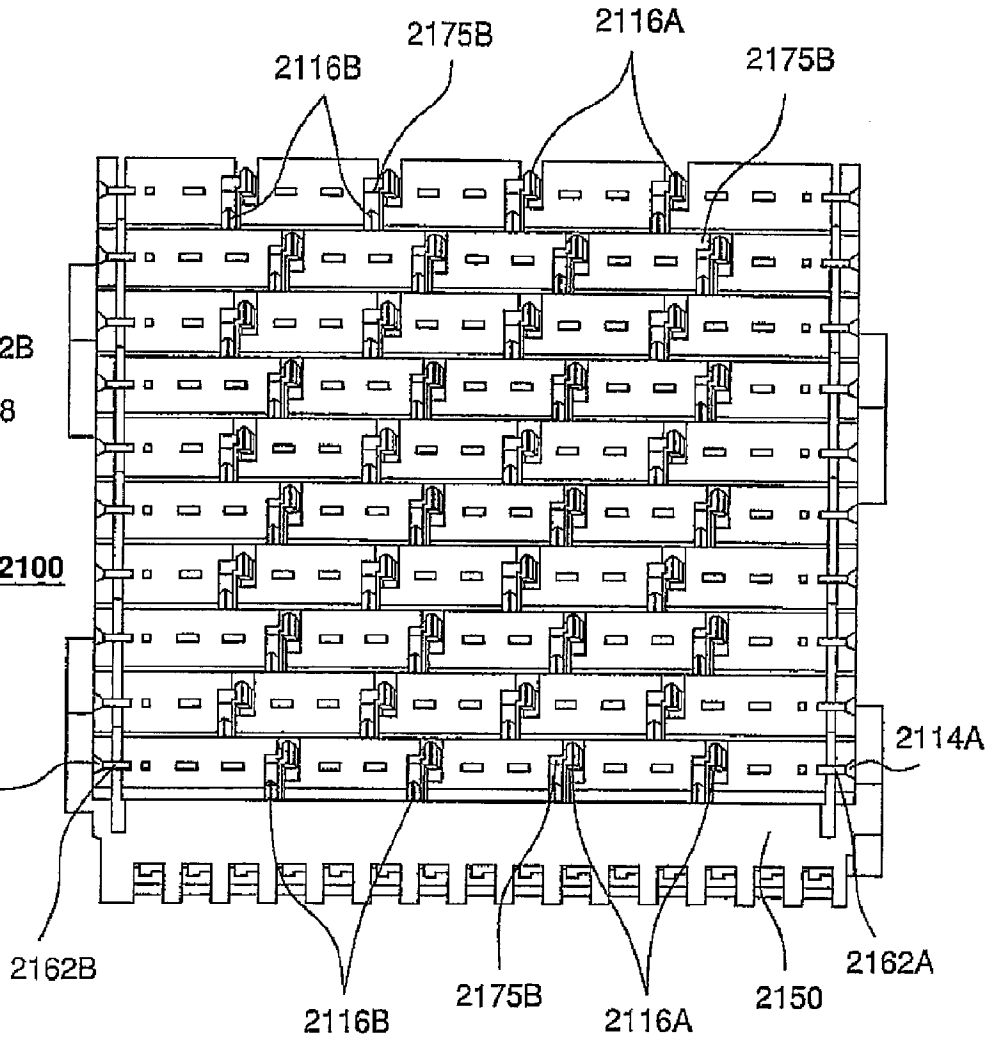
FIG. 18 is a cut-away view of the receptacle connector depicted in FIG. 16.
Figure 16:
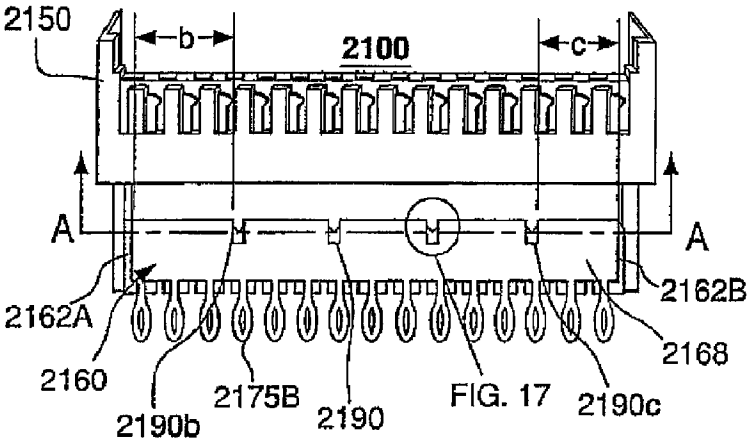
FIG. 16 depicts an example receptacle connector according to the invention.
Figure 17:
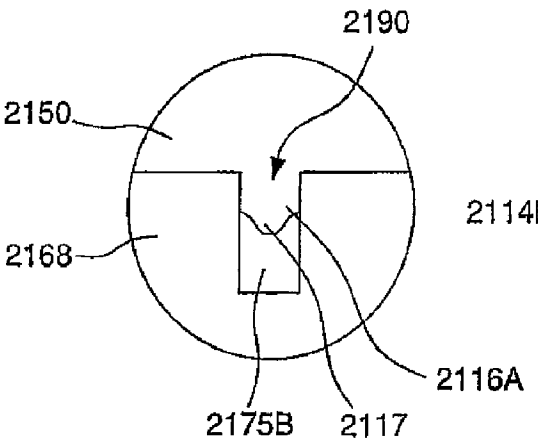
FIG. 17 is a detailed view of a portion of the receptacle connector depicted in FIG. 16.

FIG. 14 is a perspective view of an example embodiment of an alternative receptacle housing 2150 according to the invention. FIG. 15 is a perspective view of an alternative receptacle contact assembly 2160. FIG. 16 is a perspective side view of an example receptacle connector 2100 that includes the receptacle housing 2150 and the receptacle contact assembly 2160. FIG. 17 is a detailed view of a portion of the receptacle connector 2100 depicted in FIG. 16. FIG. 18 is a cut-away view of the receptacle connector 2100 depicted in FIG. 16 taken along line AA shown in FIG. 16.

The alternative receptacle contact assembly 2160 is substantially similar to the receptacle contact assembly 1160; however, the assembly 2160 includes male latch portions 2162A, 2162B formed as part of the contacts 2175A, 2175B that are located at the outermost position on the receptacle contact assembly 2160. That is, the male latch portion 2162A may be a protrusion extending from and formed as part of the signal contact 2175A at the far left-hand end of the receptacle contact assembly 2160. The male latch portion 2162B may be a protrusion extending from and formed as part of the ground contact 2175B at the far right-hand end of the receptacle contact assembly 2160. Alternatively, male latch portions may be formed as part of a contact block 2168 of the receptacle contact assembly 2160.

The receptacle housing 2150 may include female latch portions 2114A, 2114B for receiving the male latch portions 2162A, 2162B on the receptacle contact assembly 2160. The receptacle housing 2150 additionally may include a contact assembly receiving area 2152. The contact assembly receiving area 2152 may include protrusions 2116A, 2116B that extend from the housing 2150 in a direction generally indicated by arrow R that is opposite the direction in which the receptacle contact assembly 2160 is received into the receptacle housing 2150. The protrusions 2116A, 2116B may be located to correspond to wells 2190 of the contact block 2168 of the receptacle contact assembly 2160. In this way, when the receptacle contact assembly 2160 is received into the receptacle housing 2150, the protrusions 2116A, 2116B extend into respective wells 2190 of the receptacle contact assembly 2160. The mating of the protrusions 2116A, 2116B and the wells 2190 may substantially prevent movement of the assembly 2160 in either direction indicated by arrow Q.

Each protrusion 2116A, 2116B may be sized to fit snugly in a corresponding well 2190, a snug fit further aiding to prevent movement of the receptacle contact assembly 2160. Thus, the protrusions 2116A, 2116B may help to absorb sheer stress placed on the receptacle connector 2100 and, when mated with a corresponding plug connector 102, on the resulting connector system. Such sheer stress may be placed on the connector system when, for example, the connector system is mating a vertical motherboard with a horizontal daughter card. The weight of the daughter card may create a sheer force that the protrusions 2116A, 2116B, being snugly received in the wells 1190, may at least partially absorb.

Additionally, each protrusion 2116A, 2116B may be of a shape to facilitate receiving the receptacle contact assembly 2160 in the receptacle housing 2150. For example, as best seen in FIG. 17, each protrusion 2116A, 2116B may include a tip 2117 in the general shape of a triangle. This triangle shaped tip 2117 may facilitate alignment of and guiding the receptacle contact assembly 2160 as each protrusion 2116A, 2117B is inserted into a corresponding well 2190 when the assembly 2160 is being received by the housing 2150.

The protrusions 2116A, 2116B additionally may perform a polarizing function, helping to prevent the receptacle contact assembly 2160 from being received in the receptacle housing 2150 in an incorrect orientation. As shown in FIG. 16, there may be a distance c between an end of the contact block 2168 on the right-hand side to the well 2190*c* closest to the end of the contact block 2168 on the right-hand side. There may also be a distance b between the end of the contact block 2168 on the left-hand side to the well 2190*b* closest to the end of the contact block 2168 on the left-hand side. The distance c may be less than the distance b. Therefore, the receptacle contact assembly 2160 may be received in the connector housing 2150 only when each well 2190 of the receptacle contact assembly 2160 is properly aligned with a respective protrusion 2116A, 2116B on the connector housing 2150. This polarization helps assure that the receptacle contact assembly 2160 is received in a proper orientation to align the wells 2190 with the ground contacts 132B of the plug connector 102. Thus when the plug connector 102 is mated with the receptacle connector 2100, the ground contacts 132B will be properly mated with ground terminals 2175B and inserted into a corresponding well 2190. The polarization function of the protrusions 2116A, 2116B therefore helps ensure that ground contacts 132B of the plug connector 102 will not be inserted into a dual beam signal contact 2175A and bottom-out against the contact block 2168. Such bottoming-out may cause damage to a ground contact 132B of the plug connector 102 if, for example, the ground contact 132B is bent when it is pressed against the contact block 2168.

Though the example receptacle portion 2150 is depicted with a respective pair of protrusions 2116A, 2116B that align with each well 2190 of the contact block 2168, it should be understood that the number of protrusions 2116A, 2116B may be less than the number of wells 2190. Accordingly, in such an embodiment, some wells 2190 may not receive a protrusion 2116A, 2116B. For example, a receptacle housing 2150 may include only one or two protrusions 2116A, 2116B per contact block 2168.

As shown, the receptacle connector 2100 is shown as a mezzanine-style connector. That is, the dual beam contacts 2175A, 2175B may be straight. It should be understood, however, that the receptacle connector 2100 may be a "right-angle" connector, with contacts that bend at a generally right angle.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. A receptacle housing for an electrical connector for receiving a complementary electrical connector having a complementary contact, the receptacle housing comprising:

a contact assembly receiving area adapted to receive a contact assembly in only one orientation, the contact assembly comprising a contact block having a contact extending therethrough, wherein the contact defines a first beam and a second beam and wherein the contact block defines a well disposed between the first and second beams of the contact, such that when the complementary electrical connector is received, the complementary contact is received between the first beam and the second beam and within the well; and a protrusion extending from the contact assembly receiving area, the protrusion being adapted to be received into the well.

2. The receptacle housing of claim 1, wherein a location of the protrusion in the contact assembly receiving area performs a polarizing function such that the contact assembly is properly received in the contact assembly receiving area in only one orientation.

3. The receptacle housing of claim 1, wherein the protrusion comprises a size that enables it to be press-fit into the well.

4. The receptacle housing of claim 1, wherein the protrusion comprises a tip that facilitates alignment of the contact block as it is received in the receptacle housing.

5. The receptacle housing of claim 1, further comprising:

a female latch portion adapted to mate with a complementary male latch portion attached to the contact block.

6. The receptacle housing of claim 1, wherein the contact assembly receiving area is adapted to prevent movement of the contact assembly relative to the receptacle housing when a plug connector is connected to the contact assembly received in the receptacle housing.

7. The receptacle housing of claim 1, wherein the contact block is an insert molded contact block.

8. The receptacle housing of claim 1, wherein the contact is a ground contact.

9. The receptacle housing of claim 4, wherein the tip is in the shape of a triangle.

10. The receptacle housing of claim 5, wherein the male latch portion is part of the contact.

11. An electrical connector for receiving a complementary electrical connector having a complementary contact, the electrical connector, comprising:

a housing;

a contact block received in the housing; and a ground contact that defines a first beam and a second beam for receiving the complementary contact between the first beam and the second beam, the ground contact extending through the contact block, wherein the contact block defines a well disposed between the first and second beams of the ground contact for receiving the complementary contact in the well, wherein the housing defines a protrusion that is received in the well such that the housing is adapted to receive the contact block in only one orientation.

12. The electrical connector of claim 11, wherein the protrusion comprises a tip that facilitates alignment of the contact block as it is received in the housing.

13. The electrical connector of claim 11, wherein the location of the protrusion ensures that the contact block is received in the housing in only one orientation.

14. The electrical connector of claim 12, wherein the tip is in the shape of a triangle.

15. An electrical connector for receiving a complementary electrical connector having a complementary contact, the electrical connector, comprising:

a housing defining a contact assembly receiving area, the housing comprising a first protrusion extending from the contact assembly receiving area;

a contact assembly received in the contact assembly receiving area; wherein the contact assembly comprises a contact block having a first contact extending therethrough, wherein the first contact defines a first beam and a second beam, wherein the contact block defines a first well disposed between the first and second beams of the first contact, such that when the complementary electrical connector is received, the complementary contact is received between the first beam and the second beam and within the first well; and wherein the first protrusion is received in the first well.

16. The electrical connector of claim 15, wherein the housing further comprises a second protrusion, the contact block comprises a second well, and the second protrusion is received in the second well.

17. The electrical connector of claim 15, wherein the contact block is received in the housing in a receiving direction, and wherein the first protrusion extends from the housing in a direction opposite the receiving direction.

18. The electrical connector of claim 15, wherein the first protrusion comprises a size that enables it to be press-fit into the first well.

19. The electrical connector of claim 15, wherein the first protrusion comprises a tip that facilitates alignment of the contact block as it is received in the housing.

20. The electrical connector of claim 15, wherein the contact is a first ground contact.

21. The electrical connector of claim 15, wherein a location of the first protrusion in the contact assembly receiving area performs a polarizing function such that the contact assembly is properly received in the contact assembly receiving area in only one orientation.

22. The electrical connector of claim 15, wherein the housing further comprises a female latch portion and the contact assembly further comprises a male latch portion, and wherein the male latch portion is received in the female latch portion.

23. The receptacle connector of claim 15, wherein the contact block has a first signal contact extending therethrough.

24. The electrical connector of claim 19, wherein the tip is in the shape of a triangle.

25. The electrical connector of claim 22, wherein the first contact comprises the male latch portion.

26. The receptacle connector of claim 23, wherein the well defines a space capable of receiving a distal portion of a ground contact of a plug connector, thereby enabling a second signal contact of the plug connector to mate with a terminal end of the first signal contact after a ground contact of the plug mates with a terminal end of the contact.

27. An electrical connector comprising:

a plug connector comprising a plug housing and a plurality of plug contacts received in the plug housing; and a receptacle connector removably connectable to the plug connector, the receptacle connector comprising a receptacle housing, the receptacle housing comprising:

a contact assembly receiving area adapted to receive a contact assembly in only one orientation, the contact assembly comprising a contact block having a contact extending therethrough, wherein the contact defines a first beam and a second beam and wherein the contact block defines a well disposed between the first and second beams of the contact, such that when the complementary electrical connector is received, the complementary contact is received between the first beam and the second beam and within the well; and a protrusion extending from the contact assembly receiving area, the protrusion being adapted to be received into the well.

28. The electrical connector of claim 27, wherein the protrusion is located such that the contact block is received in the receptacle housing in only one orientation.

* * * * *